United States Patent [19]
Andoniev et al.
[11] 4,229,190
[45] Oct. 21, 1980

[54] ROLL-TYPE ELECTRICAL PRECIPITATOR

[76] Inventors: Sergei M. Andoniev, prospekt Pravdy, 5, kv. 60; Valentina Y. Laktjushina, prospekt 50 let VLKSM, 51, kv. 362; Viliam M. Medvedovsky, prospekt Pravdy, 5, kv. 226A; Kim S. Shuster, ulitsa Darvina, 1, kv. 36, all of Kharkov, U.S.S.R.

[21] Appl. No.: 62,404

[22] Filed: Jul. 30, 1979

[51] Int. Cl.[3] ..... B03C 3/00
[52] U.S. Cl. ..... 55/112; 55/146; 55/148; 55/152; 55/154
[58] Field of Search ..... 55/150–157, 55/146, 148, 112; 361/230–233, 225, 226, 227

[56] References Cited

FOREIGN PATENT DOCUMENTS 1013629 8/1957 Fed. Rep. of Germany ..... 55/155

*Primary Examiner*—Bernard Nozick
*Attorney, Agent, or Firm*—Lackenbach, Lilling & Siegel

[57] ABSTRACT

A roll-type electrical precipitator comprising a housing having gas inlet and outlet means, and strip-like corona discharge and collecting electrodes. The electrodes are wound as spirals about mandrels and have their end portions shaped so as to form an Archimedean spiral having a pitch equal to two electrode spacings. The electrodes are wound about a common axis, their mandrels are displaced with respect to each other by 180°, and the turns of one of the electrodes alternates in cross-section with the turns of the other electrode. Each of the electrodes is provided with holes for spacers to be passed through and fixed to the adjacent turns of the other electrodes so as to form a rigid connection between the turns of each of the electrodes.

4 Claims, 3 Drawing Figures

ROLL-TYPE ELECTRICAL PRECIPITATOR

FIELD OF THE INVENTION

The present invention relates to apparatus for electrical purification of gases, and more particularly to electrical precipitators of the roll type.

Roll-type electrical precipitators may be used in chemical industry, ferrous and nonferrous metalurgy, power engineering and manufacture of building materials.

BRIEF DESCRIPTION OF THE PRIOR ART

Known in the art is a roll-type electrical precipitator [see German Pat. No. 1013629] comprising a housing having gas inlet and outlet means, and strip.like corona discharge and collecting electrodes. The electrodes are wound as a helix about a hub and insulating material in such a way that in cross-section the turns of the corona discharge electrode alternate with those of the collecting electrode. The adjacent turns of the electrodes are insulated from each other by spacers placed therebetween. The spacers are also intended to keep a constant spacing between the corona discharge and collecting electrodes (electrode spacing).

The above electrical precipitator operates as follows. Gas which is to be purified flows along the axis of the roll between the turns of the electrodes having opposite polarity. Thus, suspended particle being charged in the electric field of the electrode spacing are deposited on the electrode surfaces.

In the described roll-type electrical precipitator, the spacers are exposed to the dust-laden gas. Therefore, in the course of gas purification, the spacers inevitably become covered with a layer of deposited particles. Since the spacers connect the electrodes of opposite polarities, the efficiency of the apparatus depends to a great extent on the electrical resistivity of the suspended particles. Therefore, the field of application of such electrical precipitators is very limited and they are used only for purifying gases laden with particles of a comparatively high electrical resistivity.

Besides, the described roll-type electrical precipitator is not of a sufficiently rigid construction. Thus, at a temperature of above 100° C., various thermal deformations of the construction elements may occur, thereby changing the electrode spacing and, hence, causing an instability of the gas purification process.

The known electrical precipitator is unable to provide a high degree of gas purification, since its construction does not allow for using electrode strips of a large area. As the spacers are disposed through the whole width of the electrodes, the working surface available for deposit of the suspended particles is reduced.

The above described electrical precipitator is disadvantageous, because to remove precipitated particles it must be shut down and dismounted, which considerably reduces its utilization factor.

BRIEF DESCRIPTION OF THE INVENTION

It is a principle object of the present invention to provide a roll-type electrical precipitator with a novel arrangement of two independent electrode systems capable of purifying gases of suspended particles differing in electrical resistivity at a temperature of above 100° C.

It is another object of the invention to provide a construction of an improved rigidity.

It is still another object of the invention to increase the degree of gas purification.

It is yet another object of the invention to increase the utilization factor of the electrical precipitator.

These and other objects are attained by a roll-type electrical precipitator comprising a housing having gas inlet and outlet means. Strip-like corona discharge and collecting electrodes are wound as a helixes about a common axis in such a way that in cross-section the turns of the corona discharge electrode alternate with turns of the collecting electrode. The turns of said electrodes are separated by spacers keeping a constant electrode spacing. According to the invention, a pair of mandrels are provided about which the electrodes are wound. The electrodes have portions at their ends made in cross-section as an Archimedean spiral with a pitch equal to two electrode spacings. Each is provided with holes through which spacers pass so they may be fixed to adjacent turns of the other electrode in such a way that the turns of each of the electrodes are rigidly connected therebetween.

The roll-type electrical precipitator enables gases to be purified of suspended particles differing in electrical resistivity at a temperature of above 100° C.

BRIEF DESCRIPTION OF THE DRAWINGS

These and other objects and advantages of the present invention will become more readily apparent from the following detailed description of an embodiment thereof given by way of an example with reference to the accompanying drawings, wherein.

DETAILED DESCRIPTION OF THE INVENTION

Figure 1:
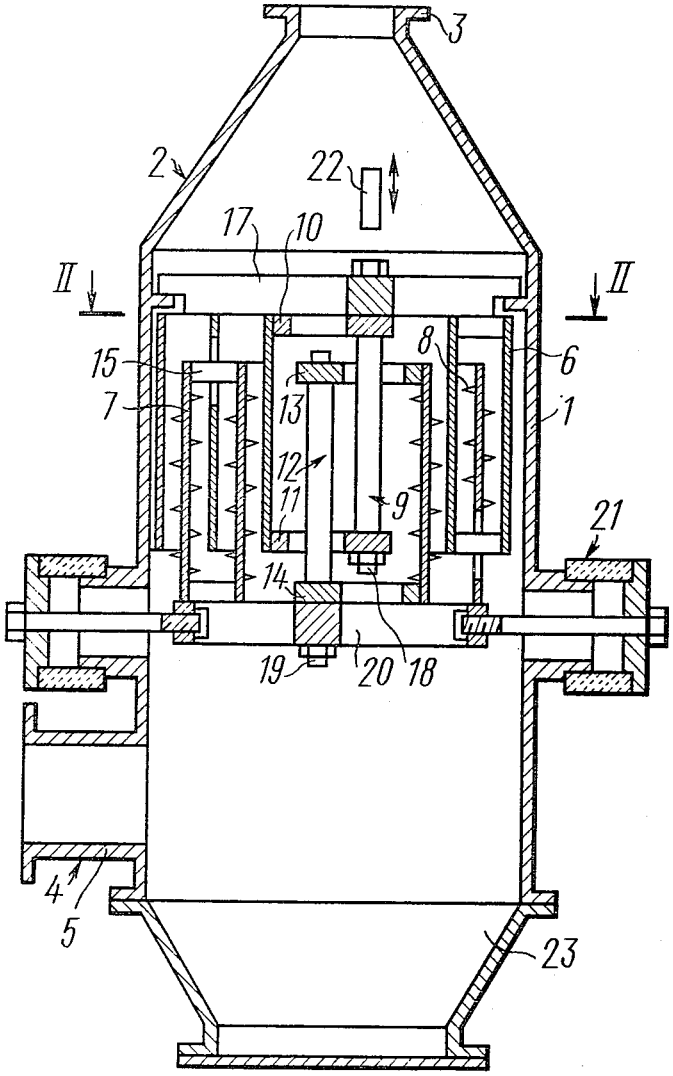
FIG. 1 is an elevational sectional view of the roll-type electrical precipitator, according to the invention.

The roll-type electrical precipitator includes a housing 1 (FIG. 1) having a gas inlet means 2 made as a jet 3 and a gas outlet means 4 made as a jet 5. The housing 1 encloses a strip-like collecting electrode 6 and a strip-like corona discharge electrode 7. On the corona discharge electrode 7 needles 8 are provided.

Figure 2:
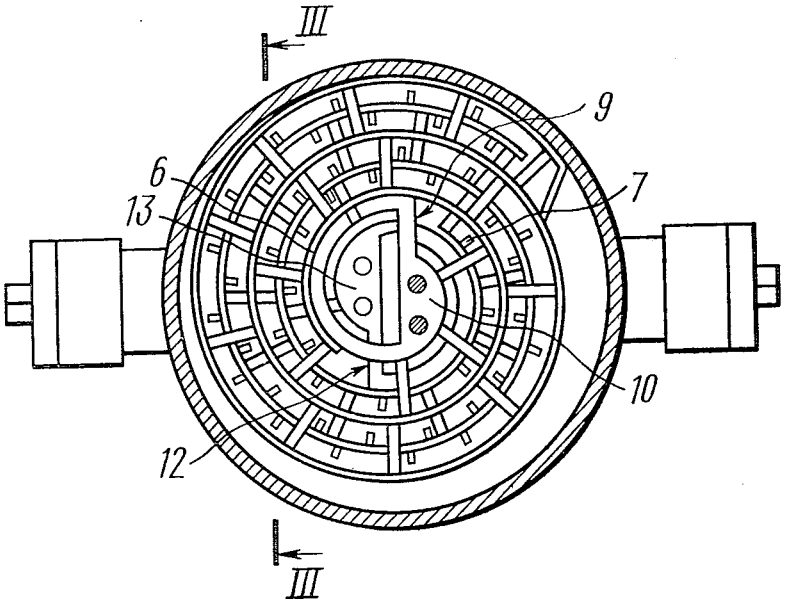
FIG. 2 is a cross-sectional view taken along the line II—II of FIG. 1.

The collecting electrode 6 (FIG. 2 ) is wound on a mandrel 9 having, according to the invention, portions 10 and 11 at the ends thereof (FIG. 1) shaped so as to form an Archimedean spiral with a pitch equal to two electrode spacings.

The corona discharge electrode 7 (FIG. 2) is wound on a mandrel 12 having, according to the invention, portions 13 and 14 at the ends thereof formed in cross-section as an Archimedean spiral with a pitch equal to two electrode spacings.

The mandrels 9 and 12 are displaced with respect to one another by 180°.

The electrodes 6 and 7 are wound about a common axis and disposed in so that in cross-section the turns of the electrode 6 alternate with the turns of the electrode 7.

The uniformity of the winding pitch of the electrodes 6 and 7 is obtained by using spacers 15 made of conductive or insulating material in the form of rods.

Figure 3:
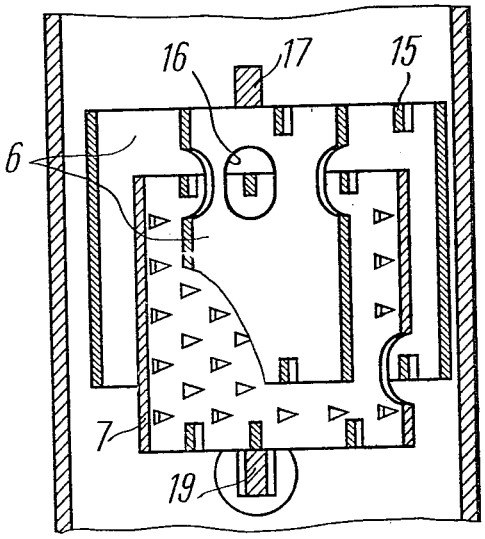
FIG. 3 is a cross-sectional view taken along the line III—III of FIG. 2.

Each of the electrodes 6 and 7, according to the invention, is provided with holes 16 (FIG. 3). The spacers 15 are to be passed through a hole of a turn of one electrode and fixed to the adjacent turns of the other electrode. In the process of winding the electrodes, the spacers 15 may be welded or cemented to an identical electrode at the points of contacts therewith.

According to the invention, each of the electrodes 6 or 7 (FIG. 2) in combination with a mandrel 9 or 12, about which it is wound, and spacers 15 fixed to the turns thereof form an independent system, the spiral turns of one system being disposed between the turns of the other system and spaced therefrom by a distance equal to the electrode spacing.

The collecting electrode 6 is fixed with bolts 18 to a frame 17 (FIG. 1) resting on the housing 1.

The corona discharge electrode 7 is clamped on to rods 19 fixed to a frame 20.

The frame 20 is insulated from the housing by means of insulators 21 disposed outside the dust-laden gas flow.

The roll-type electrical precipitator operates as follows. A dust-laden gas entering through the inlet pipe 3 flows along the axis of the precipitator into the electric field of the corona discharge electrode in the electrode spacing. Dust particles are charged by a flow of corona discharge ions and under the action of the electric field migrate to the collecting electrode 6 upon which they are deposited. As a result, the collecting electrode 6 becomes covered by a layer of particles attracted from the gas flow, and, consequently, from the outlet pipe 5 a purified gas flows.

After being shaked off by a mechanism 22 the precipitated dust particles are conveyed into a bin 23.

In order to increase the gas purification rate and improve the degree of purification, the precipitator may comprise a number of similar rolls vertically disposed in series over each other within the housing thereof. The rolls may also be arranged in parallel. The roll-type electrical preciptator according to the invention enables gases to be purged of suspended particles differing in electrical resistivity at a high concentration thereof.

The present roll-type electrical preciptiator may be used in a wide range of temperatures.

Having small overall dimensions and a low weight, the electrical preciptator according to the invention provides a high rate of gas purification.

The apparatus according to the present invention provides a high degree of gas purification.

The present roll-type electrical precipitator may be used in combination with a mechanism for cleaning electrodes without dismounting them.

The construction of the proposed roll-type electrical precipitator according to the invention permits the construction elements thereof to be standardized and its manufacture to be automated.

It is to be understood that the foregoing disclosure relates to only a preferred embodiment of the invention, and that various changes may be made in the proposed apparatus without departing from the spirit and scope of the invention set forth in the appended claim.

What is claimed is:

1. A roll-type electrical precipitator comprising a housing having:

gas inlet and outlet means;

a strip-like corona discharge electrode having holes;

a strip-like collecting electrode having holes;

first and second mandrels, each having end portions shaped as Archimedean spirals having a pitch equal to two electrode spacings, said corona discharge electrode being wound about said first mandrel to form a spiral and said collecting electrode being wound as a helix about said second mandrel, said corona discharge and collecting electrodes having a common axis of winding and said mandrels being displaced with respect to each other by 180°; and spacers for providing a constant electrode spacing between said corona discharge and said collecting electrodes, said spacers being fixed to the adjacent spiral turns of one of said electrodes and passed through a respective hole of a spiral turn of the other electrode.

2. A roll-type precipitator according to claim 1, further comprising needles on said corona discharge electrode.

3. A roll-type precipitator according to claim 1, further comprising a shaking means to shake dust particles off from said collecting electrode.

4. A roll-type precipitator according to claim 3, further comprising a bin into which said dust particles fall after being shaken from said collecting electrode.

* * * * *